US005669484A

United States Patent [19]

Paulson

[11] Patent Number: 5,669,484

[45] Date of Patent: Sep. 23, 1997

[54] PROTECTIVE COVER FOR THE MINI-SLIDE KNOB OF DIMMERS WITH MINI-SLIDE KNOBS

[76] Inventor: Tom J. Paulson, 14721 27th Ave. NE., Seattle, Wash. 98155

[21] Appl. No.: 590,953

[22] Filed: Jan. 24, 1996

[51] Int. Cl.[6] ..... H01H 9/28

[52] U.S. Cl. ..... 200/43.22; 200/43.01; 200/43.16

[58] Field of Search ..... 200/43.22, 333, 200/547, 548, 549, 550, 551, 43.16, 43.01

[56] References Cited

U.S. PATENT DOCUMENTS

| | | | |
|---|---|---|---|
| 3,657,722 | 4/1972 | Givens et al. | 200/43.22 |
| 4,978,816 | 12/1990 | Castonguay et al. | 200/43.22 |
| 5,468,925 | 11/1995 | Mohsen | 200/43.22 |

*Primary Examiner*—David J. Walczak

[57] ABSTRACT

A protective cover for the mini-slide knob of dimmers with a mini-slide knob which will allow the user to select a permanent setpoint by preventing people from accessing and changing the setting of the mini-slide knob.

4 Claims, 2 Drawing Sheets

PROTECTIVE COVER FOR THE MINI-SLIDE KNOB OF DIMMERS WITH MINI-SLIDE KNOBS

BACKGROUND—FIELD OF INVENTION

This invention relates to protective covers for mini-slide knobs of dimmers with mini-slide knobs. The present invention will prevent people from changing the setting of the mini-slide knob of related dimmers by said protective cover.

BACKGROUND—DESCRIPTION OF PRIOR ART

Exterior floodlights are commonly used for night lighting for security and area lighting at the exteriors of residential and commercial buildings.

The typical fixture has two weatherproof floodlights but some fixtures have one floodlight. The commercially available weatherproof floodlights are typically comprised of six choices: 150 watt incandescent, 120 watt incandescent, 90 watt halogen, 75 watt incandescent, 65 watt incandescent and 45 watt halogen, all with 2000 hour lifetime.

The typical control for these floodlights are on-off toggle switches. A much more cost effective means of control for these light levels would be to replace said on-off toggle switch with a commercially available dimmer with a mini-slide knob and the present invention as such:

a. Instead of a 120 watt incandescent floodlight (1370 lumens output), use a 150 watt floodlight (1740 lumens) and dim it to 79 percent illumination level. The annual savings would be $15.68 and the light bulbs would last 3.1 times as long.* b. Instead of a 90 watt halogen floodlight (1270 lumens), use a 150 watt floodlight (1540 lumens) and dim it to 73 percent illumination level. The annual savings would be $30.74 and the light bulbs would last 4.1 times as long.* c. Instead of a 75 watt incandescent floodlight (765 lumens), use a 120 watt floodlight (1370 lumens) and dim it to 56 percent illumination level. The annual savings would be $13.00 and the light bulbs would last 11.2 times as long.* d. Instead of a 65 watt incandescent floodlight (675 lumens), use a 120 watt floodlight (1370 lumens) and dim it to 49 percent illumination level. The annual savings would be $17.52 and the light bulbs would last 21 times as long.* e. Instead of a 45 watt incandescent floodlight (540 lumens), use a 120 watt floodlight (1370 lumens) and dim it to 39 percent illumination level. The annual savings would be $30.94 and the light bulbs would last 21 times as long.*

This more cost effective control is not done because the dimmers that ate available do not have a means of limiting the dimmer control to those particular values. Any set-point would be lost. The typical set-point would be "all the way up" resulting in an illumination level of 100 percent. Consequently, there would be no monetary, savings or light bulb life extension. People are not aware of the monetary and other benefits of dimming higher wattage floodlights instead of using 120 watt, 90 watt, 75 watt, 65 watt or 45 watt floodlights. People presently do not have a choice because the present invention is not available to the public and the option to use 150 watt or 120 watt floodlights as substitutes for 120 watt, 90 watt, 75 watt, 65 watt and 45 watt floodlights is not available to them.

The above savings and light bulb life multiples are based upon the following data:

a. Published data from a major dimmer manufacturer:

| Light Level | Energy Used | Lamp Life Multiples of Normal Life (100% Illumination |
|---|---|---|
| 100 percent | 100 percent | 1 |
| 90 percent | 90 percent | 2 |
| 75 percent | 80 percent | 4 |
| 50 percent | 60 percent | 20 |

b. Data from light bulb manufactures: Light bulb life is 2000 hours.

c. Lights are on 10 hours per night. Greater or lesser use would increase or decrease annual savings in direct proportion.

d. Two floodlights per fixture. This is the most common occurrence. If one floodlight were used, savings would be half. If two fixtures are on one control switch, savings would double.

e. Electrical energy costs as of November 1995 were used: $0.08 per kilowatt-hour, the national average.

f. Floodlight costs, including sales tax, were attained by averaging prices asked by averaging prices at six major retail stores in Seattle, Wash. in November, 1995:
150 watt and 75 watt incandescents: $5.90
120 watt and 65 watt incandescents: $7.11
90 watt and 45 watt halogens: $11.18

The present invention would enable the user to establish a permanent setpoint of the mini-slide dimmer, thereby enabling the user to realize monetary savings and light bulb life extension. Said protective cover will prevent people from changing the setting of the mini-slide knob of the dimmers. The settings could be made in any of these ways:

a. Place a light meter in the center of the floodlight's area of illumination and record the reading. Determine the ratio of the floodlight that is to be replaced to that which will be used (150 watt or 120 watt) and multiply the recorded illumination level by that ratio. Then, adjust the mini-slide knob until that illumination level is observed. Finally, secure the protective cover and tighten the screw. Now, the illumination level is set at the correct value to produce the light level of the floodlight that is chosen to be replaced.

b. Maximum travel of the mini-slide knob is 100 percent illumination and minimum travel is zero percent illumination. The percentage output can be approximated by interpolation between these two limits. As above, secure the protective cover and tighten the screw.

e. A visual check can be make to reduce the level to be say 55 percent or to some other level as desired. Then secure the protective cover and tighten the screw. The benefits will not be as quantifiable as a or b above, but nonetheless they will be there.

OBJECTS AND ADVANTAGES

Accordingly, besides the objects and advantages of the protective cover for mini-slide knobs of dimmers with mini-slide knobs described in my above patent, several objects and advantages of the present invention are:

(a) To provide a means to establish a permanent setpoint of a mini-slide knob, thereby limiting the illumination level of the light bulb that is being controlled, with these resultant benefits:

1. The user could save up to $30.94 per year per two-bulb fixture.
2. The user could increase the life of the light bulb by up to 20 times with these resultant benefits:
   a. Less time and energy to be spent on shopping and installation.
   b. Installation in many cases are in difficult locations, high on exterior walls and may require a ladder.
   c. Security and reliability would increase. The probability that a light bulb would extinguish when the user is on vacation or asleep would be reduced by up to 95 percent.

Further objects and advantages are to provide a protective cover for mini-slide knobs of dimmers with mini-slide knobs which is inexpensive to manufacture and inexpensive to the user. Still further objects and advantages will become apparent from a consideration of the ensuing description and drawings.

DRAWING FIGURES

DETAILED DESCRIPTION OF THE PREFERRED EMBODIMENT

Figure 1:
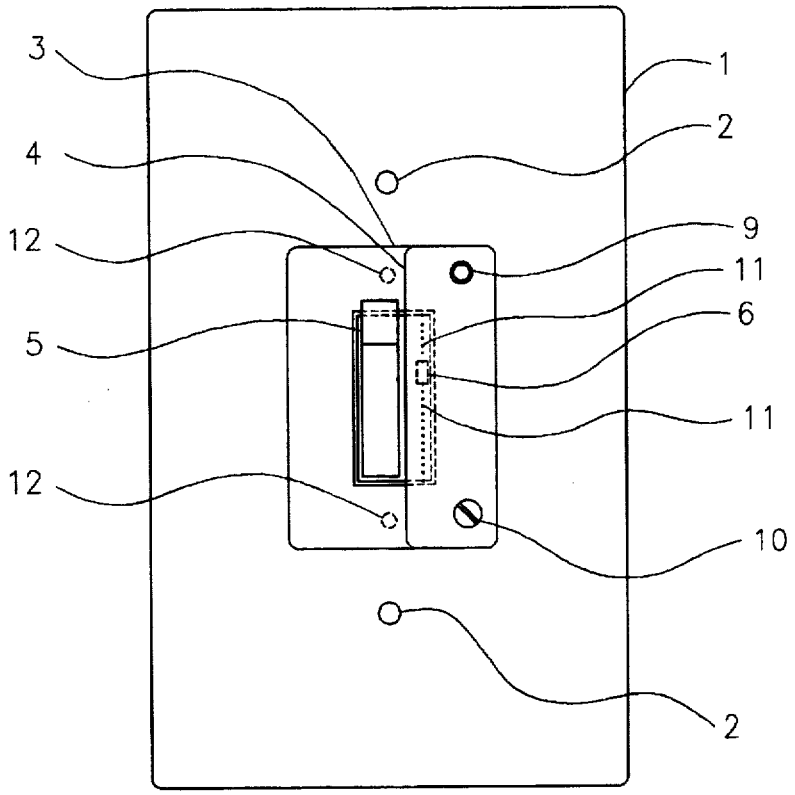
FIG. 1 is a plan view showing a dimmer with a mini-slide knob and an on-off toggle switch. The protective cover of the present invention is shown attached to the wallplate for said dimmer.

Referring now to FIG. 1, it can be seen that a protective cover for mini-slide knobs of dimmers with mini-slide knobs in accordance with the present invention comprises a baseplate 3 and a protective coverplate 4. The on-off toggle knob 5 of the dimmer and the mini-slide knob 6 for adjusting the level of illumination of the light bulbs can be seen. 11 is the path of travel of said mini-slide knob. 1 is the wallplate for the dimmer with a mini-slide knob and an on-off toggle switch and 2 are the holes for the screws which attach said wallplate to the electrical wallbox. The baseplate of the present invention is attached to the wallplate by screws 12. The protective coverplate swivels by the swivel 9 and said coverplate is secured by screw 10 to provide protection for the mini-slide knob from being reset, thereby providing a means of establishing a permanent setting for said mini-slide knob.

Figure 2:
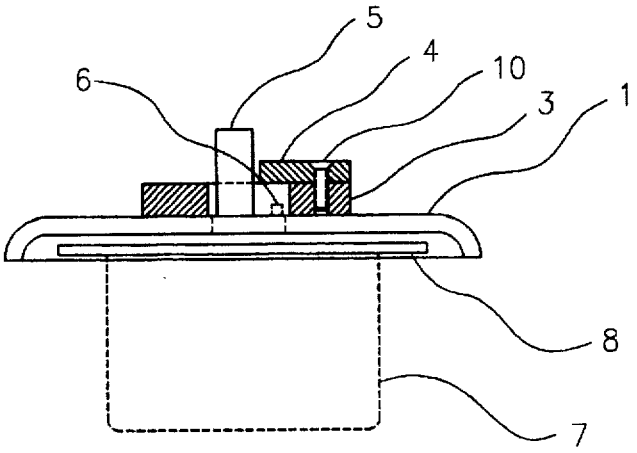
FIG. 2 is a section showing the protective cover of the present invention attached to the wallplate for said dimmer. Said dimmer, said mini-slide knob and said on-off toggle switch are shown.

Referring now to FIG. 2, the mini-slide knob 6 can be seen to be protected by the protective coverplate 4. The on-off toggle knob 5 is readily accessible. Once the desired setting for the dimmer is made, the protective coverplate is secured by screw 10. When the user turns the toggle switch on, the level of illumination of the light bulbs will remain at the selected level and people will not be able to change said selected level of illumination. 7 is the outline of the dimmer body. Said dimmer body is contained within an electrical wallbox, not shown. I is the bracket of said dimmer which is in turn secured to the electrical wallbox by screws, not shown, in its normal manner.

Figure 3:
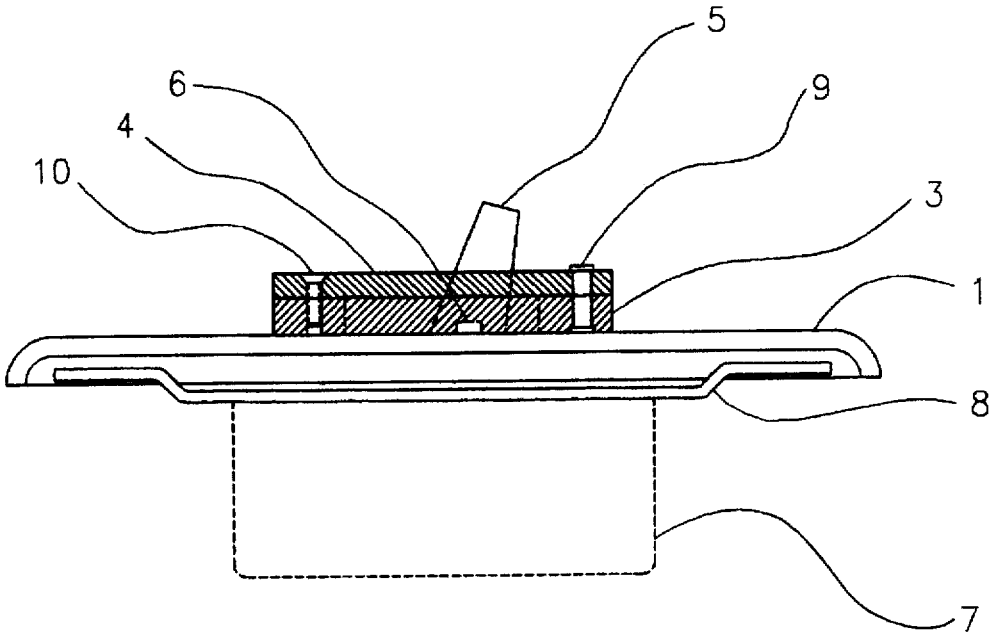
FIG. 3 is a section showing the cover swivel and the cover screw.

Referring now to FIG. 3, the protective coverplate 4 and the baseplate 3 of the present invention can be seen attached to the wallplate 1. The swivel 9 combines said protective coverplate and said baseplate into one device such that said protective coverplate can swivel to allow access to set the mini-slide knob of the dimmer at the desired setting. To secure the coverplate over the mini-slide knob, the screw 10 is tightened. Access to the mini-slide knob requires a tool.

Figure 4:
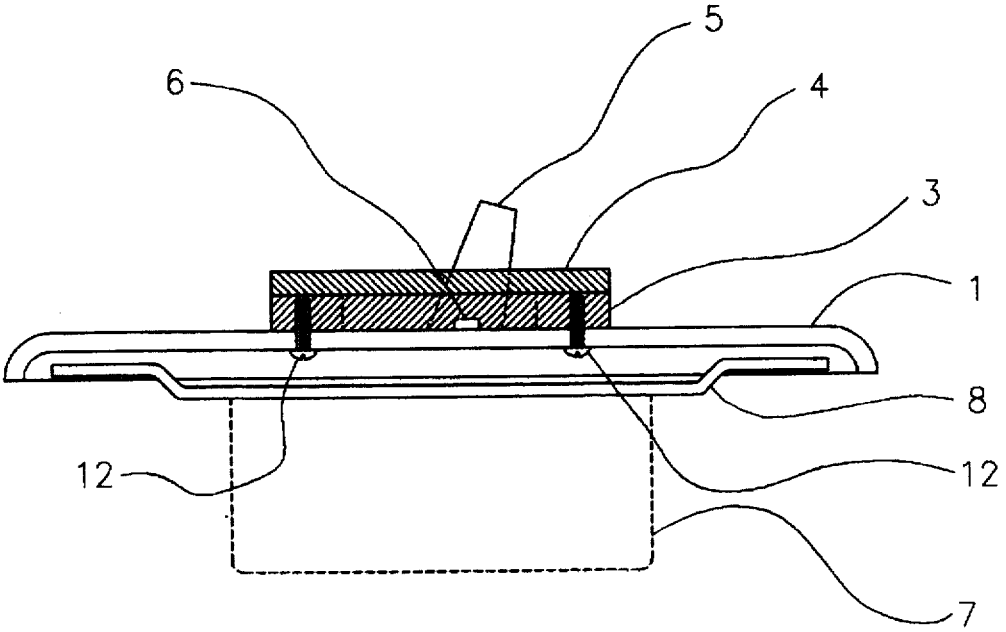
FIG. 4 is a section showing the fastening screws that secure the present invention to the wallplate.

Referring now to FIG. 4, the protective coverplate 4 and the baseplate 3 of the present invention can be seen attached to the wallplate 1 by means of screw. 12 which screw into said baseplate. The chosen setting of the mini-slide knob 6 is seen to be protected from people who might change the adjustment of said mini-slide knob by the protective coverplate. The corresponding level of illumination will now be permanent. The on-off toggle knob 5 is seen to be readily accessible to the user.

SUMMARY, RAMIFICATIONS AND SCOPE

Accordingly, the reader will see that the protective cover for the mini-slide knob of dimmers with mini-slide knobs of this invention can be used to maintain the setting of the said mini-slide knob at a selectable set point. That set point can be anywhere along the normal range of the travel of that said mini-slide knob. That set point will establish the value of illumination of the light bulbs by establishing the percent of dimming. Furthermore, the protective cover for the mini-slide knob of dimmers with mini-slide knobs has the additional advantages in that:

- It allows for setting the maximum illumination level for the light bulbs at any selected point from zero to 100 percent.
- The set point is maintained by a protective cover which prevents people from adjusting the mini-slide knob. To change that setting would require the use of a tool.
- Resultant monetary savings can be as high as $30.94 annually for one typical fixture with two floodlights. Based upon data presented in the section of this specification labeled "Background-Description of Prior Art".
- Resultant light bulb life can increase by up to 20 times the life of a light bulb that is illuminated at 100 percent.
- Security and reliability would increase. The probability that a light bulbs would extinguish when the user is on vacation or asleep would be reduced by up to 95 percent.
- Less time and energy would be spent on shopping for replacement light bulbs.
- Because lamp changes would decrease by up to 95 percent, the difficult installations that are often the case with exterior floodlighting would also be reduced by up to 95 percent.

The present invention is especially suited to control exterior floodlights. The selection of floodlight types will be reduced from six to two: 150 watt incandescent and 120 watt incandescent. Without the present invention, any set point of a dimmer with mini-slide knob would be lost. The normal tendency is to run the slide knob up to its maximum travel which is 100 percent illumination. The present invention is unavailable to the public but this invention will allow the public to realize all of the benefits outlined in this section of this specification.

Although the description above contains many specificities, these should not be construed as limiting the scope of the invention but as merely providing illustrations of some of the presently preferred embodiments of this invention. Thus the scope of the invention should be determined by the appended claims and their legal equivalents, rather than by the examples given.

I claim:

1. A cover for a switch wherein the switch has a toggle actuator and a mini slide knob adjacent to the toggle actuator for adjusting an illumination level of a light to be actuated by the toggle actuator comprising:

a wall plate adapted to be attached to the switch and having an opening therethrough for receiving the toggle actuator and the mini slide knob when the wall plate is attached to the switch;

a base plate mounted to said wall plate and having an opening therethrough which is aligned with said opening in said wall plate for enabling a user to have access to the toggle actuator and the mini slide knob;

a protective cover plate pivotally attached to one end of said base plate and adapted to cover the mini slide knob when in a first position and enable a user to have access to the mini slide knob when in a second position; and a securing means positioned on another end of said base plate for securing said protective cover plate in said first position to thereby prevent a user from gaining access to the mini slide knob.

2. The cover as claimed in claim 1, wherein said wall plate is attached to the switch with at least one screw.

3. The cover as claimed in claim 1, wherein said securing means comprises at least one screw.

4. The cover as claimed in claim 1, wherein said protective cover plate is pivotally attached to said base plate by a swivel connection.

* * * * *